US007226125B2

(12) United States Patent
Frobose et al.

(10) Patent No.: US 7,226,125 B2
(45) Date of Patent: Jun. 5, 2007

(54) CONVERTIBLE BENCH TABLE WITH MAGNETIC LOCKS

(75) Inventors: James W. Frobose, Haskins, OH (US); Timothy J. Critton, Bowling Green, OH (US)

(73) Assignee: Biofit Engineered Products, Waterville, OH (US)

( * ) Notice: Subject to any disclaimer, the term of this patent is extended or adjusted under 35 U.S.C. 154(b) by 36 days.

(21) Appl. No.: 11/105,995

(22) Filed: Apr. 13, 2005

(65) Prior Publication Data

US 2005/0242633 A1 Nov. 3, 2005

Related U.S. Application Data

(60) Provisional application No. 60/562,919, filed on Apr. 16, 2004.

(51) Int. Cl.

| | |
|---|---|
| ***A47C 13/00*** | (2006.01) |
| ***A47B 3/06*** | (2006.01) |
| ***A47B 3/14*** | (2006.01) |
| ***A47B 83/02*** | (2006.01) |
| ***A47B 85/04*** | (2006.01) |

(52) U.S. Cl. ..... 297/158.4; 297/158.5; 297/172; 297/174 R; 297/118; 297/119; 297/124; 297/125; 108/64; 108/65

(58) Field of Classification Search ..... 297/158.4, 297/118, 119, 124, 125, 158.5, 172, 174 R; 108/64, 65

See application file for complete search history.

(56) References Cited

U.S. PATENT DOCUMENTS

| | | | | | |
|---|---|---|---|---|---|
| 1,401,083 | A | * | 12/1921 | Jurkovich | 297/124 |
| 1,757,960 | A | * | 5/1930 | Greenstreet | 297/124 |
| 1,792,737 | A | * | 2/1931 | Greenstreet | 297/124 |
| 2,481,935 | A | * | 9/1949 | Larson | 297/124 X |
| 2,506,606 | A | * | 5/1950 | McCaw | 297/124 |
| 2,509,556 | A | * | 5/1950 | Zimmerman et al. | 297/124 |
| 2,561,703 | A | * | 7/1951 | Koenig | 297/124 X |
| 2,675,859 | A | * | 4/1954 | Abler | 297/124 |
| 2,745,466 | A | * | 5/1956 | Thompson | 297/124 |
| 2,758,633 | A | * | 8/1956 | Apple | 297/124 |
| 2,856,985 | A | * | 10/1958 | Lepper | 297/124 |
| 2,882,957 | A | * | 4/1959 | Anderson | 297/124 |
| 2,897,876 | A | * | 8/1959 | Austin | 297/124 X |
| 3,061,369 | A | * | 10/1962 | Haunost | 297/124 |
| 3,361,470 | A | * | 1/1968 | Erickson et al. | 297/124 |
| 3,429,283 | A | * | 2/1969 | Emil | 297/124 X |
| 3,714,906 | A | * | 2/1973 | Finestone | 108/64 |
| 4,111,482 | A | | 9/1978 | Jones | 297/158.4 |
| 4,606,575 | A | * | 8/1986 | Kodet | 297/124 |
| 4,615,559 | A | * | 10/1986 | Blondeau | 297/124 |
| 4,617,869 | A | | 10/1986 | Denomey | |
| 4,700,986 | A | * | 10/1987 | Davis et al. | 297/158.5 |

(Continued)

FOREIGN PATENT DOCUMENTS

| | | | | |
|---|---|---|---|---|
| DE | 3610232 | A1 * | 10/1987 | 108/64 |

*Primary Examiner*—Rodney B. White
(74) *Attorney, Agent, or Firm*—Emch, Schaffer, Schaub & Porcello., Co., L.P.A.

(57) ABSTRACT

A table includes a first table top section and a second table top section A magnet is positioned on the first table top section and a lock block is positioned on the opposing second table top section. The opposing first and second table top sections are magnetically locked together to form the table.

8 Claims, 7 Drawing Sheets

U.S. PATENT DOCUMENTS 4,801,175 A * 1/1989 Albanese ..... 297/124
4,815,393 A * 3/1989 Pollak ..... 108/65 X
4,942,829 A * 7/1990 Harris ..... 108/65 X
5,292,172 A * 3/1994 Watts et al. ..... 297/158.4 X
5,425,313 A * 6/1995 Rowan ..... 108/65
5,622,118 A * 4/1997 Rowan ..... 108/65
5,692,799 A * 12/1997 Sheets ..... 297/124
5,704,683 A * 1/1998 Cooper et al. ..... 297/124
5,820,208 A 10/1998 Miklinevich ..... 297/158.5 X
6,027,093 A 2/2000 Reiher
6,102,475 A * 8/2000 Hamann ..... 297/172
6,189,965 B1 * 2/2001 Hecht et al. ..... 297/124
6,231,121 B1 * 5/2001 Chrisco et al. ..... 297/124
2006/0180055 A1 * 8/2006 Mulmed ..... 108/64

* cited by examiner

CONVERTIBLE BENCH TABLE WITH MAGNETIC LOCKS

CROSS REFERENCE TO RELATED APPLICATIONS

This application claims the benefit of U.S. provisional patent application Ser. No. 60/562,919 filed Apr. 16, 2004.

FIELD OF THE INVENTION

The present invention relates to the art of folding tables and benches.

Portable, foldable tables, benches and the like have been known for many years. Generally, the purpose of the folding tables, benches and the like is to have a table that folds into a preferably flat or closed position when not in use so that the table can be conveniently stored. When the table is in use and extended to its full size, it is important to have the table be secure and able to support the weight of the users.

Therefore, another desired property is that the table be as sturdy as possible without having heavy or large parts so that the table can be easily maneuvered between the open and closed positions by the users.

Still another desired property of the folding tables, benches and the like is that the opening and closing of the table be made as simple as possible without the need for special tools, special latching mechanisms or special skills of the persons folding or unfolding the table. Further, low production costs and simplicity of design are also desired.

Convertible bench tables can transform a cafeteria into an auditorium and requires fewer tables, less labor and time for setup/take down. The convertible unit rolls on its own four wheels, no carrying required. The tables fold and nest when in storage, freeing up valuable space for other uses.

With a multipurpose table/seating system, the seating capacity can be increased over traditional tables and chairs in a cafeteria setting. Fold the tops down and the system quickly and easily converts into comfortable bench seating with backrests. external tools, levers, or handles are required, just line up the magnets with the steel lock block of the opposite table and move together. The tables can be easily unlocked by grasping the two tables from the ends, and sliding the magnets apart. The application of magnets, combined with the rubber feet of the leg frame, provide for a very stable non-moveable table during use by occupants.

Therefore, it is an object of the present invention to provide an improved foldable furniture concept.

Another object of the present invention is to provide furniture with multiple uses and purposes. Still another object of invention is to provide furniture that is safe, stable and reliable.

Another object of the invention is to provide furniture that is easy to set-up, easy to fold and easy to store.

Another object of the present invention is to provide furniture that is easily adaptable for other uses. Another use of the present invention is that users, in particular children, cannot accidentally be injured during the opening or closing of the table.

Another object of the present invention is to provide a portable integrated combination bench and table for use in many environments.

The present invention provides a further advance in the art of folding tables and benches by providing a folding table which is a convertible between being a table with a bench and to a bench with a back support. The present invention further provides a simple structure which is relatively inexpensive to produce.

The present invention provides a folding table which is a convertible into a bench. The present invention is especially suitable in areas which need multi-task furniture such as schools and other public facilities such as conference rooms and the like in which use of foldable, movable and multi-use furniture is advantageous. In such an arrangement, it is often desirable to either move, remove or rearrange the furniture such that at one point the room is useful for having tables while at another point the room would be more suitable if benches were available. The present invention supplies that need by having table halves which convert between a table and a bench and which table halves are easily movable.

While the need for lightweight, durable and multi use tables and benches have been recognized for a long time, there continues to be a need for readily assembled furniture which has few moving parts and which is very safe for all types of users. The present invention overcomes the disadvantages of many prior types of collapsible furniture by eliminating complex linkages and complex locking mechanisms to hold the parts of the table and bench together.

DESCRIPTION OF THE PREFERRED INVENTION

Figure 1:
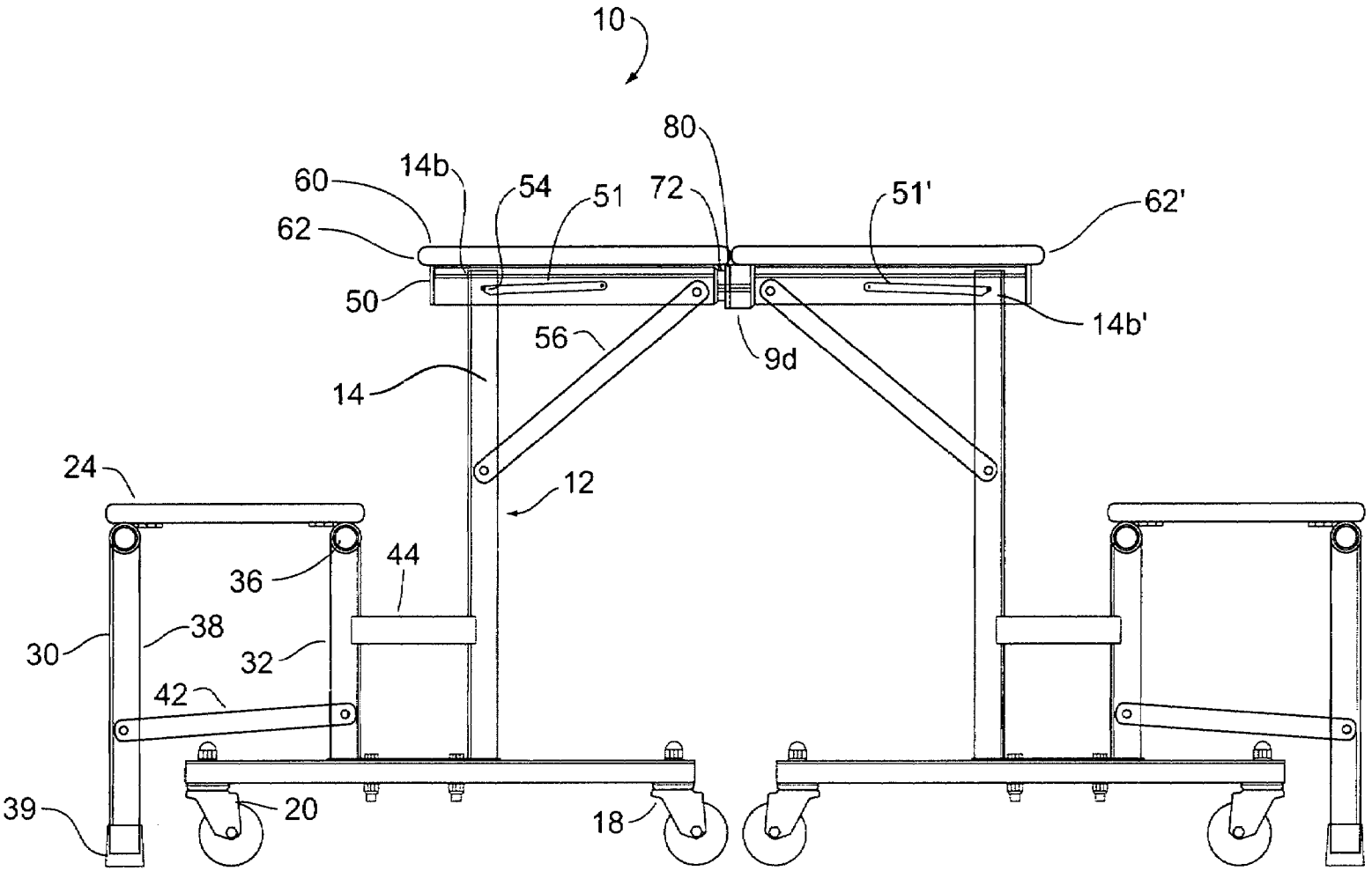
FIG. 1 is a side elevation view, showing two convertible bench tables in alignment and held in place by a magnetic lock mechanism.

FIG. 1 generally shows two convertible bench tables 10 and 10' moved together to make one "picnic" table type set up. It should be understood that according to the present invention the convertible bench tables are substantially identical. For ease of illustration, only one bench table will be discussed in detail and it should be understood that the opposing bench table has identical parts. When discussion of both convertible bench tables is necessary, identical parts will be identified by identical numbers, distinguishable by a prime marking. Referring again to FIG. 1, the convertible bench table 10 generally includes a frame mechanism 12. The frame generally includes a table support 14 secured to a coaster bar 16. Coasters 18 and 20 are mounted on opposite ends of the coaster bar 16. In practice it has been found desirable to use locking coasters for at least two of the coasters 18 or 20 attached to the coaster bar 16. The coaster bar 16 further supports a seat support frame 30. This seat support frame 30 has a rear leg 32 operatively connected to the coaster bar 16 at a first end. The second end of leg 32 terminates at a seat 24. The seat 24 is operatively and pivotally connected to the rear leg 32 by a suitable pivoting or fulcrum mechanism 36. The seat 24 is connected at an opposing end to front leg 38 by a pivoting mechanism 40. The front leg 38 and rear leg 32 are pivotally connected to a leg positioning bar 42. The front leg 38 has a rubber foot 39 position on the end that engages the support surface for the bench table. The rear leg 32 is operatively connected to the table support 14 by a post cross tube 44.

The table support 14 is connected at an upper end to a tabletop channel support 50 by a pivoting mechanism 54. A table top brace 56 is pivotally connected to a mid portion of the table support 14 at a first end and a distal portion of the table top brace 56 is pivotally connected to a cross channel 58. The tabletop channel support 50 and the cross channel 58 form a rectangular frame, for supporting a tabletop 60.

Figure 2B:
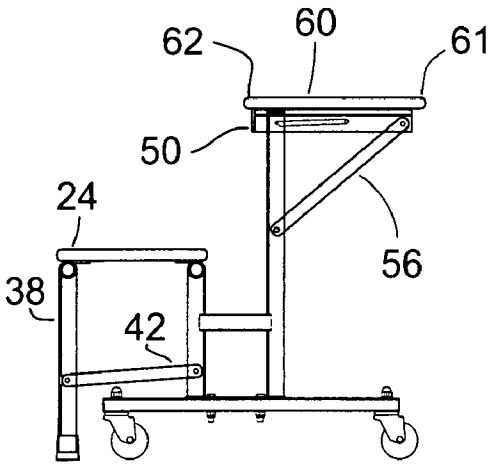
FIG. 2*b* is a side elevation view, showing a single convertible bench table in a fully opened and table configuration.

FIG. 2*b* shows the convertible bench table in the unfolded or open position.

Figure 3A:
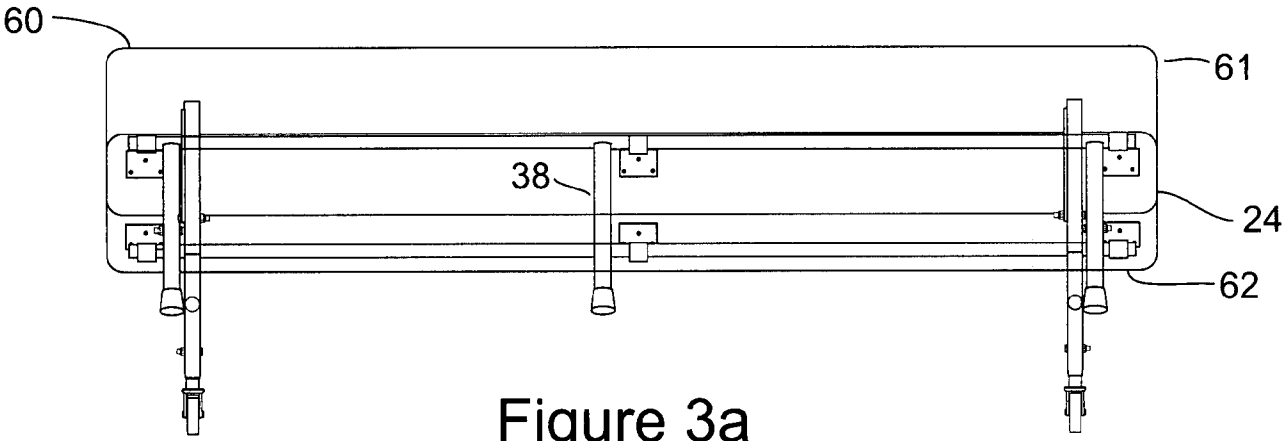
FIG. 3*a* is a front elevational view, showing the convertible bench table in a folded or closed position.
Figure 3C:
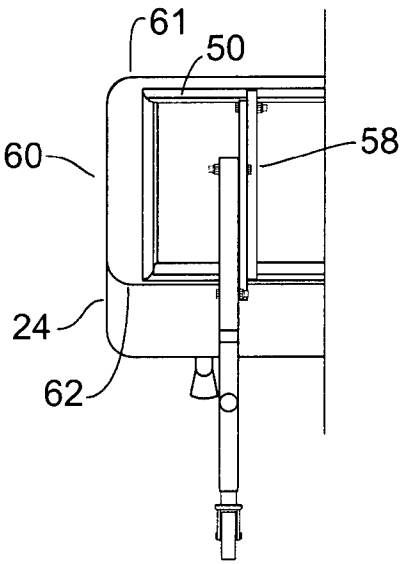
FIG. 3*c* is a partial rear elevational view, of a one end of a convertible bench table in the folder or closed position.
Figure 3B:
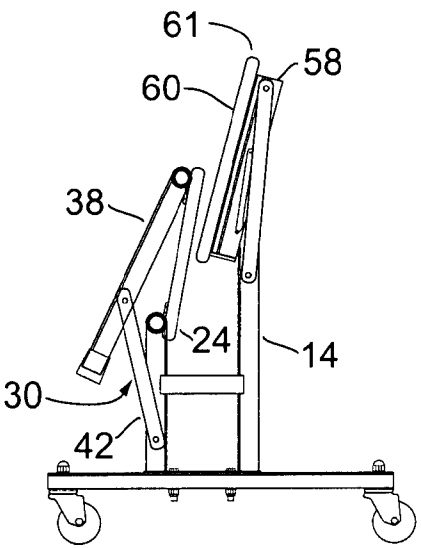
FIG. 3*b* is a side elevation view, showing the convertible bench table in a folder or closed position.

FIGS. 3*a*, 3*b* and 3*c* shows the bench table in a fully folded or closed position where the seat support frame 30 is pivoted about the pivot mechanisms 36 and 40 and the positioning bar 42 is pivoted so that tabletop 60 and seat 24 are in a folded or collapsed and substantially vertical position.

When the convertible bench table 10 is being converted from a table configuration to a bench configuration, or when the convertible bench tables are being folded, the tabletop 60 is moved into a generally vertical position. The end of the table support 14 has a pivoting mechanism 54 that slidably moves along a channel 51 in the channel support 50. The table top 60 is pivoted in a manner such that an inner edge 61 of the table top 60 is rotated in an upward direction while an exterior end 62 is pivoted in a downward direction toward the seat 24. During such pivoting motion the channel 51 in the channel support 50 slides along the pivoting mechanism 54 on the end of the table support 14 to allow the table top 60 to change orientation.

Figure 8:
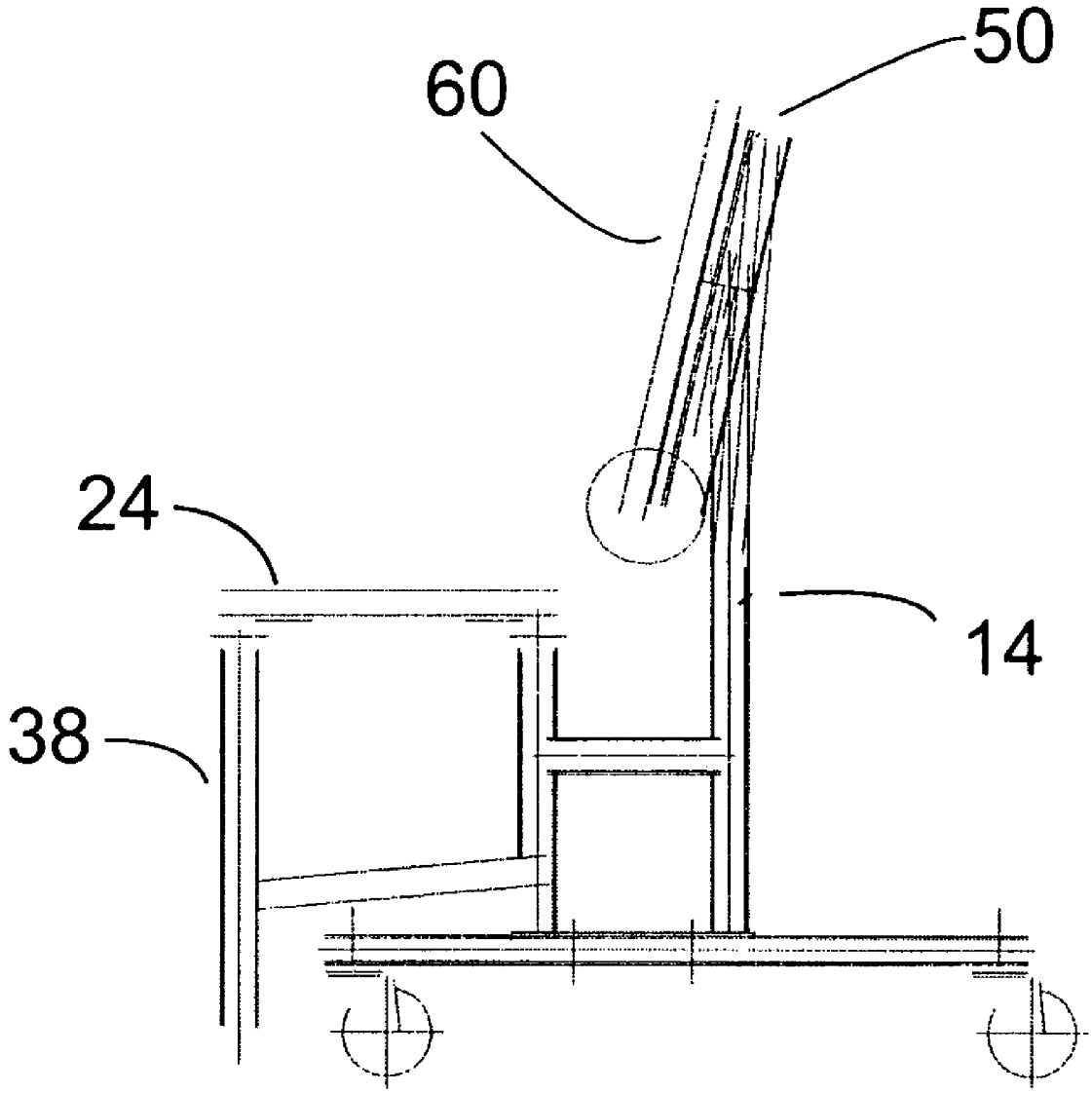
FIG. 8 is a side elevation view of a single bench table in the partially opened eng bench configuration.

The table top 60 and the frame defined by the table channel support 50 and cross channel 58 are pivoted about the table support 14. As shown in FIG. 3*b*, the tabletop 60 and seat 24 are in a generally vertical position when the bench table is fully folded. Further, as shown, in FIG. 8, the seat 24 can be unfolded or opened such that the front leg 38 is pivoted to a position where the seat 24 is in a generally horizontally position such that a bench is formed whereby the tabletop 60 acts as a backrest for the bench.

Figure 4A:
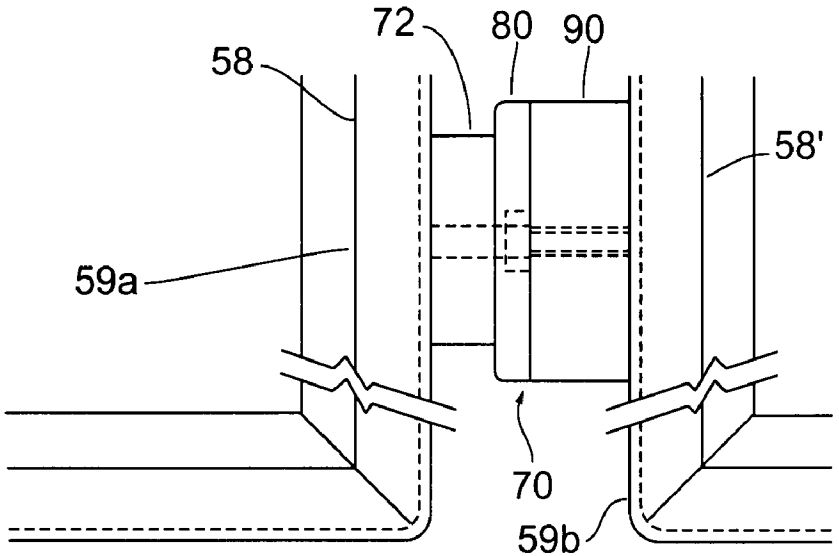
FIG. 4*a* is a partial bottom view showing the magnetic locks attached to the table frame.
Figure 4B:
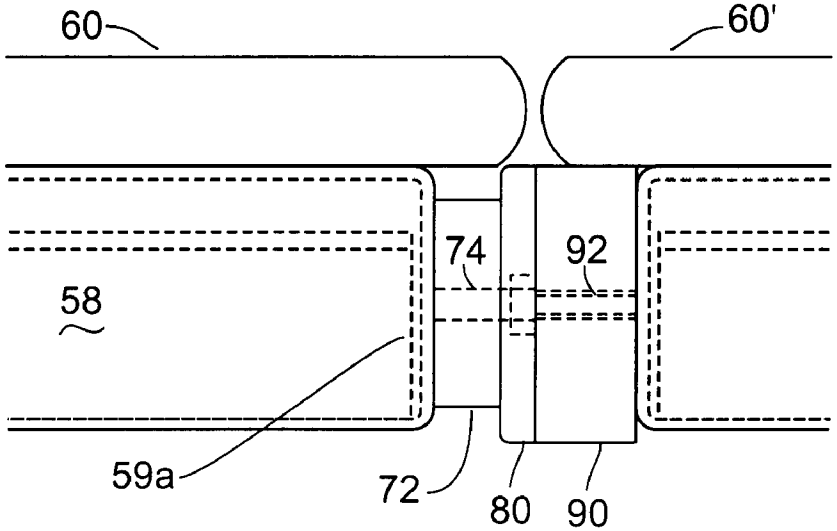
FIG. 4*b* is a partial side elevation view, showing the magnetic lock.
Figure 5A:
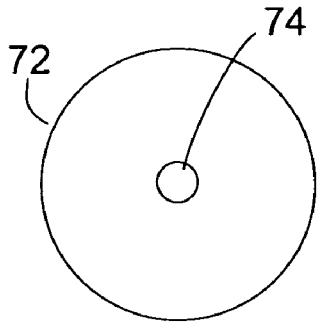
FIG. 5*a* is a front view of a magnet spacer.
Figure 5B:
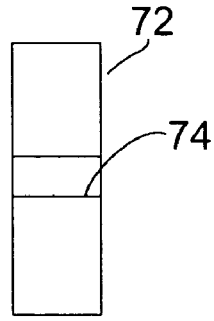
FIG. 5*b* is a side elevation view, of the magnet spacer shown in FIG. 5*a*.

According to one aspect of the present invention two convertible bench tables can be moved together to make a "picnic table" type set up. Opposing convertible bench tables 10 and 10' are secured together using a magnetic locking mechanism 70, as best shown in FIGS. 4*a* and 4*b*. The magnetic locking assembly 70 includes a spacer 72 operatively connected to the table top channel support and preferable adjacent a first end 59*a* of the tabletop channel support 58. A magnet assembly 80 is positioned adjacent the spacer 72. In a preferred embodiment, the spacer 72 is made of a suitable material such as steel and can have the general dimension and shape as shown in FIGS. 5*a* and 5*b*. However, it should be understood that other configurations can be used for the spacer 72. The spacer 72 defines an opening 74 for receiving a suitable bolt or other type of mechanism to secure the spacer 72 to the tabletop channel support 58 in a suitable manner as shown in FIG. 9.

Figure 7A:
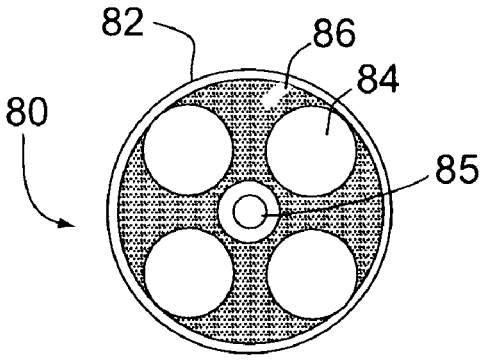
FIG. 7*a* is a front view of a magnet assembly.
Figure 7B:
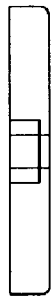
FIG. 7*b* is a side elevation view of the magnet assembly shown in FIG. 7*a*.
Figure 9:
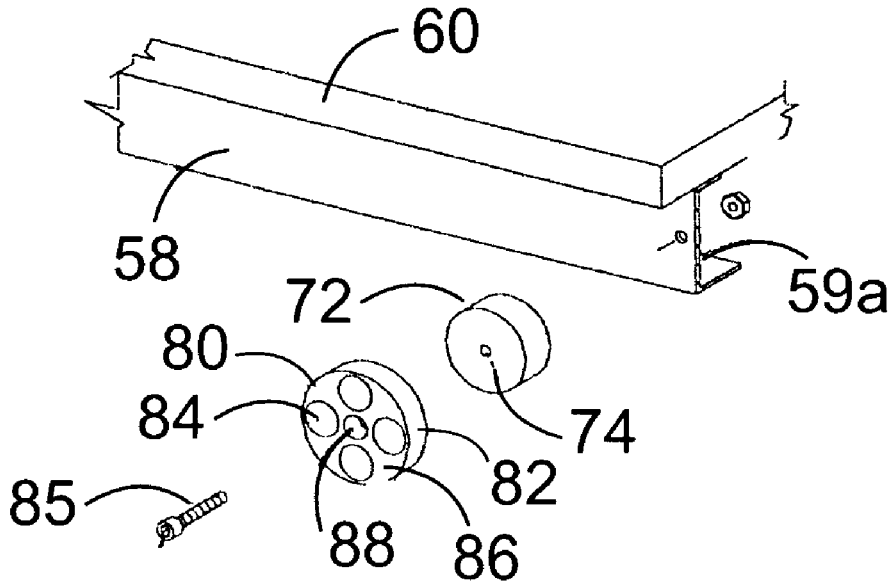
FIG. 9 is a partial perspective view showing the position of the magnet.

The magnet assembly 80 is positioned adjacent the spacer 72 and can be secured by the same bolt or mechanism 85, as shown in FIG. 9. FIG. 7*a* shows one configuration of a magnet assembly comprising a generally a circular shell 82 an at least one, and preferably a plurality of, individual magnets 84 secured within the shell 82. The remaining area within the shell 82 can be filled by any suitable filler material 86. However, it should be understood that other configurations can be used for the magnet assembly. In practice it has been found that a neodymium-iron-boron cup magnet assembly works well as the magnetic material. A suitable opening 88 extends through the magnet assembly 80 to receive a securing mechanism, such as a bolt to secure the magnet assembly 80 to the spacer 72 and to the tabletop channel support 58. Each convertible bench table 10 has a spacer 72 and magnet assembly 80, connected to a first end 59*a* of the table support channel 58.

Figure 2A:
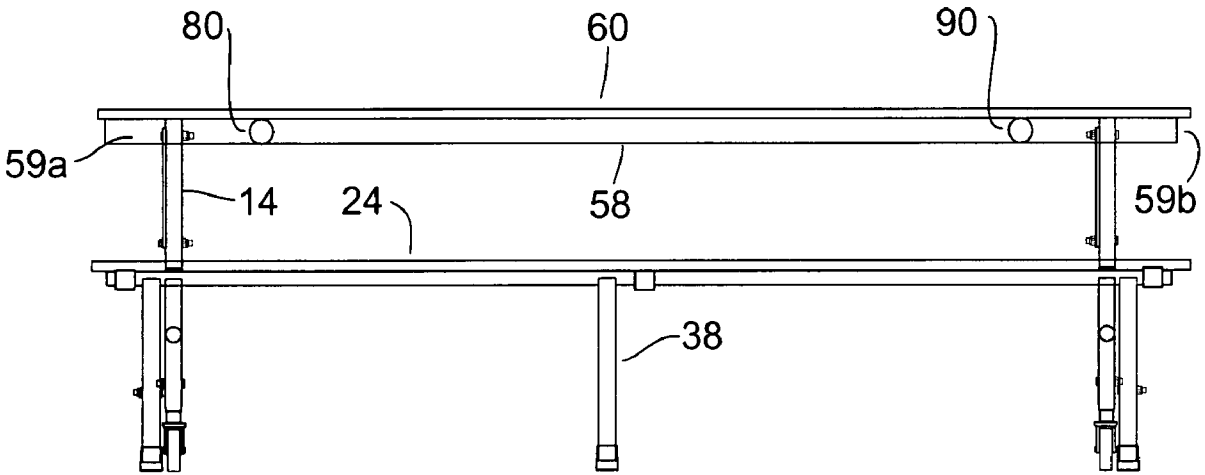
FIG. 2*a* is a front elevation view, of a single convertible bench in an open table configuration.
Figure 6A:
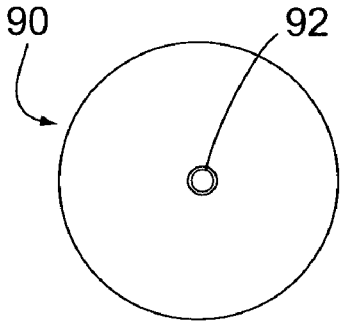
FIG. 6*a* is a front view of a lock block.
Figure 6B:
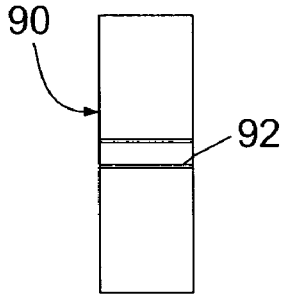
FIG. 6*b* is a side elevation view, of the lock block of FIG. 6*a*.
Figure 10:
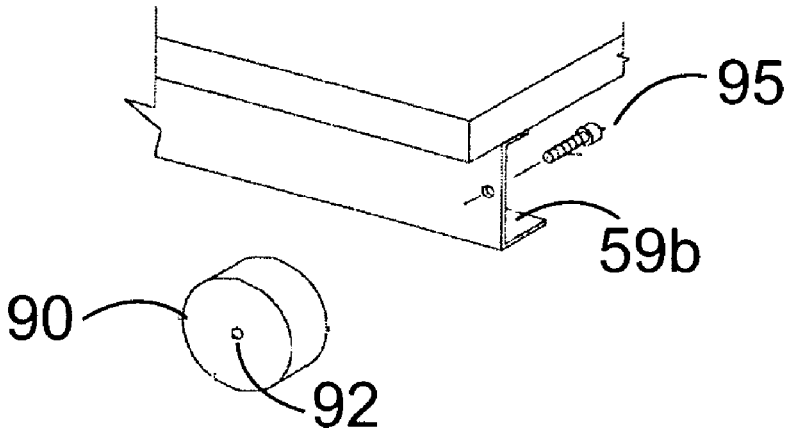
FIG. 10 is a partial perspective view showing the position of the lock block.

Each convertible table has a lock block 90 secured to the table support channel and preferably a second end 59*b* of the table support channel 58, as best seen in FIGS. 4*a*, 4*b* and 10. Thus, each convertible bench table has, spacer 72 and magnet 80 adjacent one-end 59*a* of the table support channel. While at the opposite end 59*b* of the table support channel, the lock block 90 is positioned. The lock block 90 generally comprises a material such as steel that is attracted to magnets, as is generally shown in FIGS. 6*a* and 6*b*. The lock block defines an opening 92 for receiving a securing mechanism such as a bolt 95, as shown in FIG. 10. Thus, as shown in FIG. 2*a*, the magnet assembly 80 is adjacent the first end 59*a* while the lock block 90 is adjacent the second end 59*b* of the convertible bench table 10. Thus, when two convertible bench tables 10 and 10' are positioned in a facing arrangement, the magnet assembly 80 of the first convertible bench table 10 is in opposing and aligned relationship to the lock block 90' of the second convertible bench table 10' and the magnet assembly 80' of the second bench table 10' is in opposing and aligned relationship with the lock block 90 in the first bench table 10. This arrangement is also shown schematically in FIGS. 4*a* and 4*b*. This arrangement allows for universal placement of convertible bench table into opposing relationship to form a table. The magnet assembly 80, 80' contacts the lock block 90', 90 respectively to hold the opposing convertible bench table 10 and 10' in a mating engagement and to prevent the tables from separating from one another while in use.

Referring now in particular to FIGS. 1, 2*a*, 2*b*, 3*a*, 3*b* and 3*c*, when the opposing convertible bench tables 10 and 10' are in an opposing and locked engagement, the magnets 84, 84' in the magnetic assembly 80, 80' are attracted to and magnetically connected or secured to the lock block 90', 90 respectively, which is made of a suitable magnetically attractive material. When it is desired to disengage the magnetically connected convertible bench tables, the tables are pulled apart. In practice it has been preferable to apply a shear type of force, that is a force that is parallel to the surface of the magnets and the lock block to separate the bench tables. It is to be understood that the magnets can have any desirable holding power; but it has been found that a holding power in the range from about 100 to about 200 pounds works well. It has also been found that in certain embodiments, the magnetic holding power ranges from about 125 to about 175 pounds. This holding force is provided in a direction that is perpendicular to the face of the magnets and the lock block. However if the separating force is applied in a shear direction the force necessary to separate the magnet from the lock block is from about 40 to about 80 lbs. Thus, the separating force, when applied in the preferred manner, can be sufficiently less than the maximum holding power between the magnet and the lock block. This allows people familiar with the bench tables to assemble and disassemble the bench tables with greater ease than someone that is just a user of the tables. In addition, the rubber foot 39 on each front let 38 will engage the floor upon which the bench table is located and resist movement that will separate the magnet from the lock block. The locking coasters 18, 20 can also, when in the locked position, resist movement of the bench table in a direction that separates the magnet from the lock block. It is to be understood that the magnetic holding power is desired to be sufficient to hold the opposing bench tables 10 and 10' in magnetic mating engagement during use, while allowing ordinary strength users to separate the convertible bench tables when desired.

Although the present invention has been described with respect to its preferred embodiments, those skilled in the art will recognize changes which may be made in the aforementioned embodiments which do not depart from the spirit of the invention already described in the specification and embodied in the following claims.

We claim:

1. A table comprising:

a first table top section; said first table top section is pivotally secured to a first bench assembly at least one magnet secured to said first table top section; said at least one magnetic having a face disposed to engage another surface;

a second table top section; said second table top section is pivotally secured to a second bench assembly at least one lock block secured to said second table top section, said lock block being formed of a magnetically attractive material whereby said first and second table top sections are positioned to place said face of said magnet on said first table top section in engagement with said lock block on said second table section to releasably secure said first and second table top sections together to form said bench table assembly, wherein the at least one magnet and at least one lock block provide a holding force of from about 40 to about 80 pounds in a direction parallel to said face of said at least one magnet.

2. The table of claim 1 wherein a bench is pivotally secured to said first and second bench table assemblies.

3. The table of claim 2 wherein said first table top section and said bench on said first bench table assembly and said second table top section and said bench on said second bench table assembly can be pivoted to a substantially vertical orientation for storage of the first and second bench table assemblies.

4. The table of claim 2 wherein said first and second table top sections are pivoted to a substantially vertical orientation to form a back rest for said benches when said benches on said first and second table assemblies are in a substantially horizontal position to form a seat.

5. The table of claim 1 wherein more than one magnet is secured to said first table top section and more than one lock block is secured to said second table top section, said magnets being disposed to be in alignment with a lock block when said first and second table top sections positioned to form said table.

6. The table of claim 1 wherein the first table top section and the second table top section has a first end and a second end, a magnet is secured to the first end and a lock block is secured to the second end of said first table top sections a magnet is secured to the second end and a lock block is secured to the first end of the second table top section whereby said magnet on said first table top section will be in alignment with and engage said lock block on said second table top section and said magnet on said second table top section will be in alignment with and engage said lock block on said first table top section when said first and second table top sections are positioned to form said table whereby said magnets and lock blocks releasably secure said first and second table top sections together.

7. The table of claim 1 wherein said at least on magnets provides a holding force from about 100 pound to about 200 pounds in a direction perpendicular to the face of the at least one magnet.

8. A table comprising:

first bench table assembly;

a table top secured to said first bench table assembly, said table top having a first end and a second end;

a magnet positioned adjacent said first end of said table top;

a lock block secured to said second end of said table top, said lock block being formed of a magnetically attractive material;

a second bench table assembly substantially identical to said first bench table assembly positioned adjacent said first bench table assembly whereby said magnet on said first bench table assembly is in alignment with and engages said lock block on said second bench table assembly and said magnet in said second bench table assembly is in alignment with and engages said lock block on said first bench table assembly to releasably secure said first bench table assembly to said second bench table assembly to for said table.

* * * * *